US007739839B1

(12) United States Patent
Crabtree

(10) Patent No.: US 7,739,839 B1
(45) Date of Patent: Jun. 22, 2010

(54) DOWN SPOUT SAFETY EDGE SYSTEM

(76) Inventor: Joshua P. Crabtree, 2061 Citrus Hill La., Palm Harbor, FL (US) 34683

( * ) Notice: Subject to any disclaimer, the term of this patent is extended or adjusted under 35 U.S.C. 154(b) by 348 days.

(21) Appl. No.: 12/004,385

(22) Filed: Dec. 20, 2007

(51) Int. Cl.
*E04D 13/064* (2006.01)

(52) U.S. Cl. ..... 52/16; 138/96 R; 52/11; 52/716.1; 52/716.2; 52/716.6; 52/716.7; 285/293.1

(58) Field of Classification Search ..... 52/16, 52/11, 716.1, 716.2, 716.6, 716.7; 138/96 R, 138/109, 110; 285/293.1
See application file for complete search history.

(56) References Cited

U.S. PATENT DOCUMENTS

| | | | | | |
|---|---|---|---|---|---|
| 2,290,842 | A * | 7/1942 | Bush | 428/583 |
| 2,794,757 | A | 6/1957 | Bright | |
| 3,167,856 | A * | 2/1965 | Zoller | 29/413 |
| 3,222,769 | A * | 12/1965 | Le Plae | 29/413 |
| 4,105,814 | A * | 8/1978 | Eggert | 428/122 |
| 4,695,499 | A | 9/1987 | Whitener | |
| 4,830,898 | A * | 5/1989 | Smith | 428/122 |
| 4,869,945 | A * | 9/1989 | Harney | 428/122 |
| 5,280,138 | A * | 1/1994 | Preston et al. | 174/152 G |
| 5,701,931 | A * | 12/1997 | Phillips et al. | 137/533.29 |
| 6,182,676 | B1 * | 2/2001 | Lee | 134/167 C |
| 6,247,271 | B1 * | 6/2001 | Fioritto et al. | 49/490.1 |
| 6,341,626 | B1 * | 1/2002 | Davenport et al. | 138/110 |
| 6,367,508 | B1 * | 4/2002 | Richards et al. | 138/96 T |
| 6,889,985 | B2 * | 5/2005 | Bonds | 277/651 |
| 7,278,450 | B1 * | 10/2007 | Condon | 138/89 |
| 2002/0133952 | A1 | 9/2002 | Kenney | |
| 2004/0187394 | A1 * | 9/2004 | Brochu | 52/12 |
| 2008/0142108 | A1 * | 6/2008 | Baker et al. | 138/96 R |
| 2008/0203725 | A1 * | 8/2008 | Willeke | 285/123.6 |

OTHER PUBLICATIONS www.trimlok.com, Dec. 5, 2007, Trim-Lok, Inc., Plastic and Rubber Trims and Seals.

* cited by examiner

*Primary Examiner*—Richard E Chilcot, Jr.
*Assistant Examiner*—Alp Akbasli

(57) ABSTRACT

An elbow is positionable at the lower end of a down spout. A protective strip fabricated of an elastomeric material is positioned over the bottom of the elbow. The strip is fabricated to include an elongated member in a generally C-shaped cross sectional configuration. The elongated member covers a portion of the bottom of the elbow. The protective strip is fabricated to also include an elongated component in a generally C-shaped cross sectional configuration. The elongated component fabricated of a metallic material and is totally encased within the elastomeric material. The component is adapted to be crimped onto the bottom of the elbow.

9 Claims, 2 Drawing Sheets

FIG 3
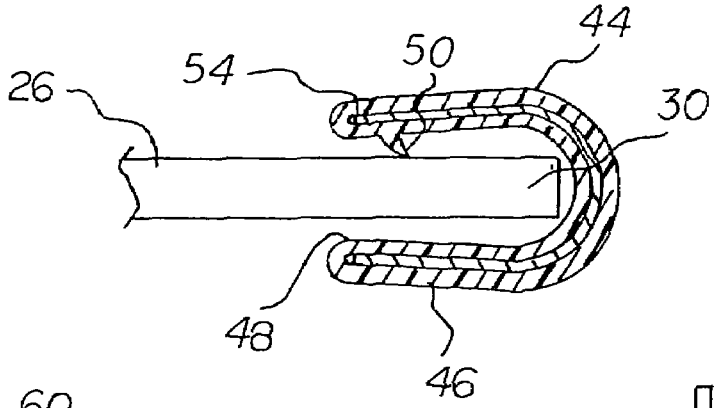
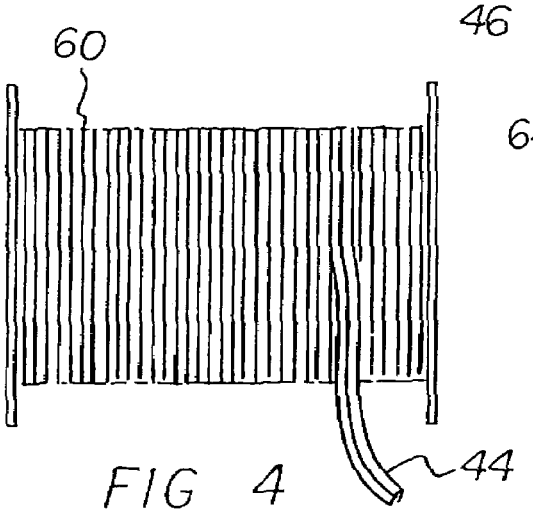
FIG 4
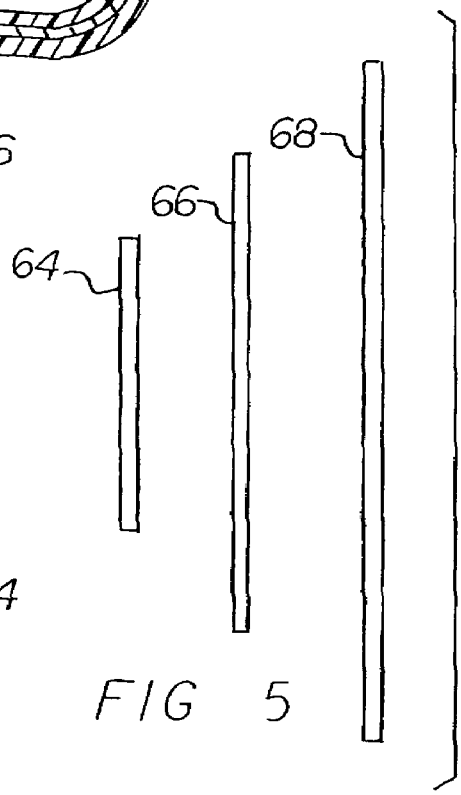
FIG 5
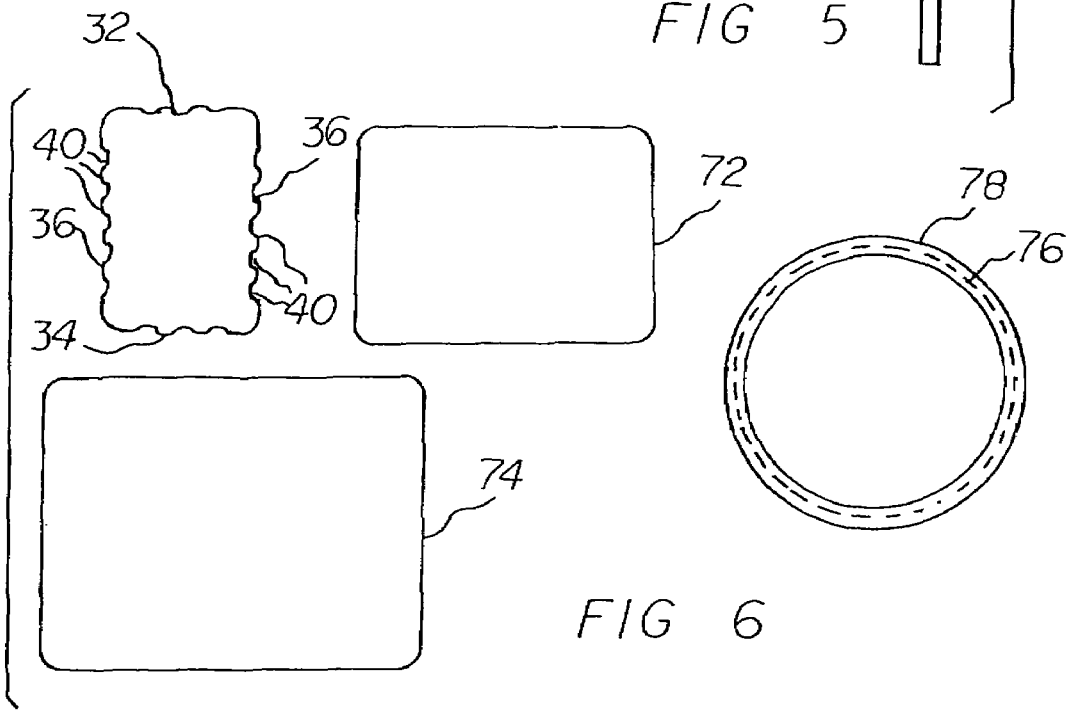
FIG 6

DOWN SPOUT SAFETY EDGE SYSTEM

BACKGROUND OF THE INVENTION

1. Field of the Invention

The present invention relates to a down spout safety edge system and more particularly pertains to covering the sharp lower edge of an elbow on a down spout in order to abate accidental cutting in a safe, convenient and economical manner.

2. Description of the Prior Art

The use of edges and trims of known designs and configurations is known in the prior art. More specifically, edges and trims of known designs and configurations previously devised and utilized for the purpose of covering edges through known methods and apparatuses are known to consist basically of familiar, expected, and obvious structural configurations, notwithstanding the myriad of designs encompassed by the crowded prior art which has been developed for the fulfillment of countless objectives and requirements.

By way of example, United States Published Application 2002/0133952 published Sep. 26, 2002 to Kenney discloses a Knife Blade. Guard. U.S. Pat. No. 4,695,499 issued Sep. 22, 1987 to Whitener discloses a Beading Profile Strip. U.S. Pat. No. 2,794,757 issued Jun. 4, 1957 to T. J. R. Bright discloses Beading, Moulding or the Like. Lastly, A website, www.trim-lok.com dated Dec. 5, 2007 by Trim-Lok, Inc. discloses Plastic and Rubber Trims and Seals.

While these devices fulfill their respective, particular objectives and requirements, the aforementioned patents do not describe a down spout safety edge system that allows for covering the sharp lower edge of an elbow on a down spout in order to abate accidental cutting in a safe, convenient and economical manner.

In this respect, the down spout safety edge system according to the present invention substantially departs from the conventional concepts and designs of the prior art, and in doing so provides an apparatus primarily developed for the purpose of covering the sharp lower edge of an elbow on a down spout in order to abate accidental cutting in a safe, convenient and economical manner.

Therefore, it can be appreciated that there exists a continuing need for a new and improved down spout safety edge system which can be used for covering the sharp lower edge of an elbow on a down spout in order to abate accidental cutting in a safe, convenient and economical manner. In this regard, the present invention substantially fulfills this need.

SUMMARY OF THE INVENTION

In view of the foregoing disadvantages inherent in the known types of edges and trims of known designs and configurations now present in the prior art, the present invention provides an improved down spout safety edge system. As such, the general purpose of the present invention, which will be described subsequently in greater detail, is to provide a new and improved down spout safety edge system and method which has all the advantages of the prior art and none of the disadvantages.

To attain this, the present invention essentially comprises a down spout safety edge system. First provided is a structure. The structure has a roof. The roof has a rain gutter. The roof has a down spout. The down spout has a horizontal higher end. The down spout has a horizontal lower end. The down spout has an elbow. The elbow is provided at the lower end of the down spout. Each of the ends of the down spout is in a rectangular configuration. The elbow has a rectangular top.

The rectangular top of the elbow is coupled to the lower end of the down spout. The elbow has a free bottom. The bottom of the elbow is in a vertical plane. The bottom of the elbow is in a generally rectangular configuration. The bottom of the elbow has a short horizontal upper edge. The bottom of the elbow has a short horizontal lower edge. The bottom of the elbow has long vertical side edges. The side edges are provided between the upper and lower edges. The top of the elbow has corner crimping. The upper and lower and side edges of the bottom of the elbow all have undulations. Each of the undulations has a radius of curvature of 1.00 inches plus or minus 20 percent.

A protective strip is provided. The protective strip is positioned over the sharp upper and lower and side edges of the bottom of the elbow. The protective strip includes an elongated member. The elongated member is in a generally C-shaped cross sectional configuration. The elongated member has ends. The ends are spaced. In this manner an opening is formed. The opening has a spacing of about 0.1875 inches plus or minus 20 percent. The opening has a depth of about 0.375 inches plus or minus 20 percent. The elongated member covers a portion of the upper and lower and side edges of the bottom of the elbow. In this manner harm to a person touching the elbow is abated. The protective strip also includes a finger. The finger is provided within the opening. The finger deforms in response to contact with the undulations of the elbow. The elongated member and finger are fabricated of an elastomeric material. The elastomeric material is selected from the class of elastomeric materials. The class of elastomeric materials includes plastic and rubber, natural and synthetic, and blends thereof.

The protective strip is fabricated to also include an elongated component. The elongated component is in a generally C-shaped cross sectional configuration. The elongated component is totally encased within the elastomeric material. The component is fabricated of a metallic material. The component is adapted to be crimped onto the bottom of the elbow. The component is further adapted to deform to varying extents in response to the undulations of the elbow. In this manner movement of the protective strip with respect to the elbow after crimping is abated both longitudinally and laterally. The protective strip has ends in contact with each other. In this manner a seam is formed. The seam is provided adjacent to one side edge of the bottom of the elbow essentially mid way between the upper and lower edges.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved down spout safety edge system which has all of the advantages of the prior art edges and trims of known designs and configurations and none of the disadvantages.

It is another object of the present invention to provide a new and improved down spout safety edge system which may be easily and efficiently manufactured and marketed.

It is further object of the present invention to provide a new and improved down spout safety edge system which is of durable and reliable constructions.

An even further object of the present invention is to provide a new and improved down spout safety edge system which is susceptible of a low cost of manufacture with regard to both materials and labor, and which accordingly is then susceptible of low prices of sale to the consuming public, thereby making such down spout safety edge system economically available to the buying public.

Even still another object of the present invention is to provide a down spout safety edge system for covering the sharp lower edge of an elbow on a down spout in order to abate accidental cutting in a safe, convenient and economical manner.

Lastly, it is an object of the present invention to provide a new and improved down spout safety edge system. An elbow is positionable at the lower end of the down spout. The elbow has a bottom. A protective strip is positioned over the bottom of the elbow. The protective strip is fabricated of an elastomeric material. The strip is fabricated to include an elongated member. The elongated member is in a generally C-shaped cross sectional configuration. The elongated member covers a portion of the bottom of the elbow. The protective strip is fabricated to also include an elongated component. The elongated component is in a generally C-shaped cross sectional configuration. The elongated component is totally encased within the elastomeric material. The component is fabricated of a metallic material. The component is adapted to be crimped onto the bottom of an elbow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken at line 3-3 of FIG. 2.

FIG. 4 is a front elevational view of a roll of edge guarding material as utilized in FIGS. 1 through 3.

FIG. 5 is a front elevational view of a strips of edge guarding material cut to different sizes and as utilized in FIGS. 1 through 3.

FIG. 6 is a front elevational view of various elbow edges adapted to receive edge guarding material, the circular edge being covered with edge guarding material.

The same reference numerals refer to the same parts throughout the various Figures.

DESCRIPTION OF THE PREFERRED EMBODIMENT

Figure 1:
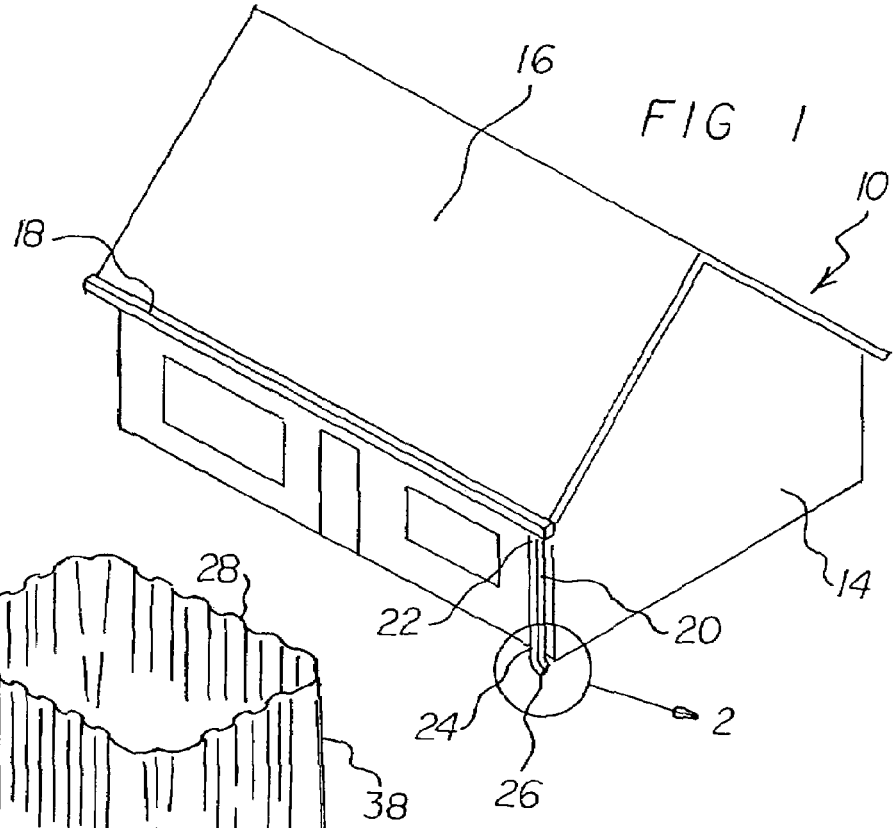
FIG. 1 is a perspective illustration of a structure utilizing a down spout safety edge system constructed in accordance with the principles of the present invention.
Figure 2:
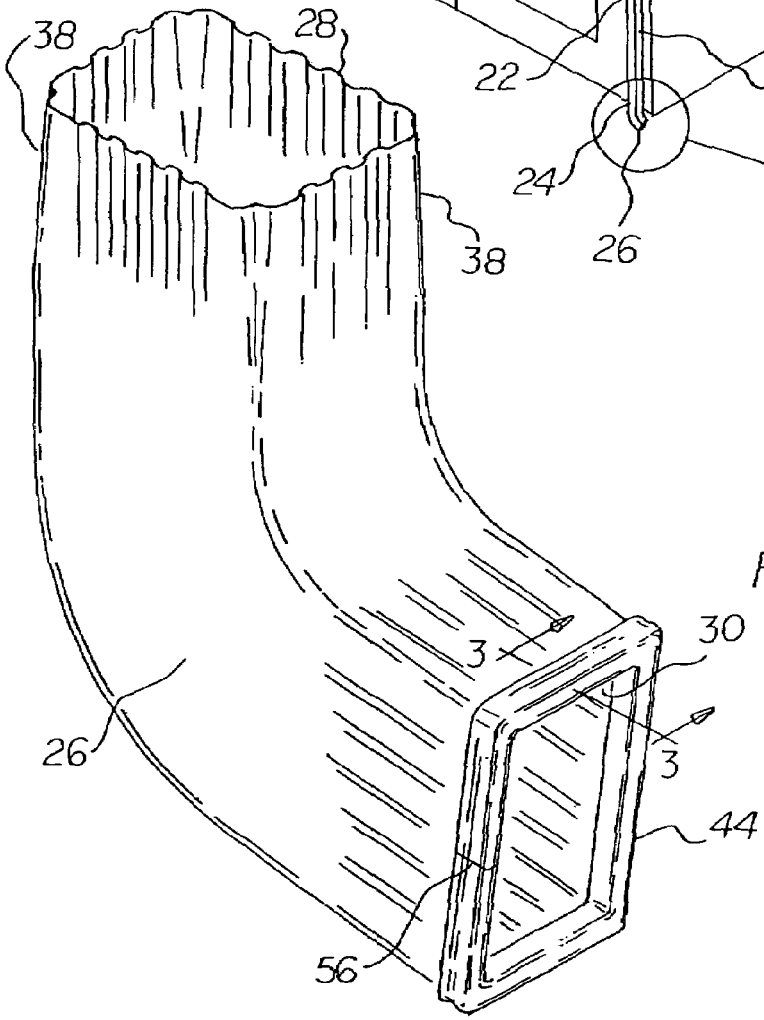
FIG. 2 is an enlarged perspective illustration of the elbow taken at circle 2 of FIG. 1.

With reference now to the drawings, and in particular to FIG. 1 thereof, the preferred embodiment of the new and improved down spout safety edge system embodying the principles and concepts of the present invention and generally designated by the reference numeral 10 will be described.

The present invention, the down spout safety edge system 10 is comprised of a plurality of components. Such components in their broadest context include an elbow and a protective strip. Such components are individually configured and correlated with respect to each other so as to attain the desired objective.

First provided is a structure 14. The structure has a roof 16. The roof has a rain gutter 18. The roof has a down spout 20. The down spout has a horizontal higher end 22. The down spout has a horizontal lower end 24. The down spout has an elbow 26. The elbow is provided at the lower end of the down spout. Each of the ends of the down spout is in a rectangular configuration. The elbow has a rectangular top 28. The rectangular top of the elbow is coupled to the lower end of the down spout. The elbow has a free bottom 30. The bottom of the elbow is in a vertical plane. The bottom of the elbow is in a generally rectangular configuration. The bottom of the elbow has a short horizontal upper edge 32. The bottom of the elbow has a short horizontal lower edge 34. The bottom of the elbow has long vertical side edges 36. The side edges are provided between the upper and lower edges. The top of the elbow has corner crimping 38. The upper and lower and side edges of the bottom of the elbow all have undulations 40. Each of the undulations has a radius of curvature of 1.00 inches plus or minus 20 percent.

A protective strip 44 is provided. The protective strip is positioned over the sharp upper and lower and side edges of the bottom of the elbow. The protective strip includes an elongated member 46. The elongated member is in a generally C-shaped cross sectional configuration. The elongated member has ends. The ends are spaced. In this manner an opening 48 is formed. The opening has a spacing of about 0.1875 inches plus or minus 20 percent. The opening has a depth of about 0.375 inches plus or minus 20 percent. The elongated member covers a portion of the upper and lower and side edges of the bottom of the elbow. In this manner harm to a person touching the elbow is abated. The protective strip also includes a finger 50. The finger is provided within the opening. The finger deforms in response to contact with the undulations of the elbow. The elongated member and finger are fabricated of an elastomeric material. The elastomeric material is selected from the class of elastomeric materials. The class of elastomeric materials includes plastic and rubber, natural and synthetic, and blends thereof.

The protective strip is fabricated to also include an elongated component 54. The elongated component is in a generally C-shaped cross sectional configuration. The elongated component is totally encased within the elastomeric material. The component is fabricated of a metallic material. The component is adapted to be crimped onto the bottom of the elbow.

The component is further adapted to deform to varying extents in response to the undulations of the elbow. In this manner movement of the protective strip with respect to the elbow after crimping is abated both longitudinally and laterally. The protective strip has ends in contact with each other. In this manner a seam 56 is formed. The seam is provided adjacent to one side edge of the bottom of the elbow essentially mid way between the upper and lower edges.

In the first alternate embodiment of the present invention, the protective strip is supplied from a roll 60. The protective strip is cut to size for a particular application. Note FIG. 4.

In the second alternate embodiment of the present invention, the protective strip is supplied in pre-cut segments 64, 66, 68. The pre-cut segments are provided in a proper size for a particular application. Note FIG. 5.

In the third alternate embodiment of the present invention, the elbow has a bottom in a rectangular configuration 72, 74. Note FIG. 6. The bottom is provided in any of a plurality of sizes.

In this forth alternate embodiment of the present invention, the elbow has a bottom. The bottom has undulations 40.

In the fifth alternate embodiment of the present invention, the elbow 76 is provided. The elbow has a bottom. The bottom is in a circular configuration. Note FIG. 6 again.

In the final alternate embodiment of the present invention, the protective strip 78 is provided. The protective strip is in a continuous loop-shaped configuration. Note FIG. 6 yet again.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A down spout safety edge system comprising:

an elbow positionable at the lower end of the down spout with a bottom; and a protective strip positioned over the bottom of the elbow fabricated of an elastomeric material, the strip being fabricated to include an elongated member with a generally C-shaped cross sectional configuration and covering a portion of the bottom of the elbow, the protective strip being fabricated to also include an elongated component with a generally C-shaped cross sectional configuration totally encased within the elastomeric material, the component being fabricated of a metallic material adapted to be crimped onto the bottom of an elbow.

2. The system as set forth in claim 1 wherein the protective strip is supplied from a roll and cut to size for a particular application.

3. The system as set forth in claim 1 wherein the protective strip is supplied in pre-cut segments and provided in a proper size for a particular application.

4. The system as set forth in claim 1 wherein the elbow has a bottom in a rectangular configuration in any of a plurality of sizes.

5. The system as set forth in claim 1 wherein the elbow has a bottom with undulations.

6. The system as set forth in claim 1 wherein the protective strip include a seam located between the bottom and top edge of the elbow.

7. The system as set forth in claim 1 wherein the elbow has a bottom in a circular configuration.

8. The system as set forth in claim 1 wherein the protective strip is in a continuous loop-shaped configuration.

9. A down spout safety edge system for covering the sharp lower edge of an elbow on a down spout in order to abate accidental cutting in a safe, convenient and economical manner, comprising, in combination:

a structure having a roof with a rain gutter and a down spout, the down spout having a horizontal higher end and a horizontal lower end and with an elbow at the lower end of the down spout, each of the ends of the down spout being in a rectangular configuration, the elbow having a rectangular top coupled to the lower end of the down spout and a free bottom, the bottom of the elbow being in a vertical plane formed in a generally rectangular configuration with a short horizontal upper edge and a short horizontal lower edge with long vertical side edges between the upper and lower edges and with the top being formed with corner crimping, the upper and lower and side edges of the bottom of the elbow all being formed with undulations, each of the undulations having a radius of curvature of 1.00 inches plus or minus 20 percent; and a protective strip positioned over the sharp upper and lower and side edges of the bottom of the elbow, the protective strip being fabricated to include an elongated member with a generally C-shaped cross sectional configuration and with ends spaced to form an opening having a spacing of about 0.1875 inches plus or minus 20 percent and a depth of about 0.375 inches plus or minus 20 percent and covering a portion of the upper and lower and side edges of the bottom of the elbow to abate harm to a person touching the elbow, the protective strip also including a finger within the opening deforming in response to contact with the undulations of the elbow, the elongated member and finger being fabricated of an elastomeric material selected from the class of elastomeric materials including plastic and rubber, natural and synthetic, and blends thereof;

the protective strip being fabricated to also include an elongated component with a generally C-shaped cross sectional configuration totally encased within the elastomeric material, the component being fabricated of a metallic material adapted to be crimped onto the bottom of the elbow and deformed to varying extents in response to the undulations of the elbow whereby movement of the protective strip with respect to the elbow after crimping is abated both longitudinally and laterally, the protective strip having ends in contact with each other to form a seam formed adjacent to one side edge of the bottom of the elbow essentially mid way between the upper and lower edges.

* * * * *